US007601010B1

(12) United States Patent
Wu

(10) Patent No.: US 7,601,010 B1
(45) Date of Patent: Oct. 13, 2009

(54) PLUG CONNECTOR WITH IMPROVED CABLE ARRANGEMENT AND HAVING RETAINING ARRANGEMENT SECURELY RETAINING MATING SUBSTRATE THEREIN

(75) Inventor: Jerry Wu, Irvine, CA (US)

(73) Assignee: Hon Hai Precision Inc. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/321,080

(22) Filed: Jan. 12, 2009

(51) Int. Cl.
*H01R 12/00* (2006.01)

(52) U.S. Cl. ..... 439/76.1; 439/606; 439/466; 439/468; 439/694; 439/902

(58) Field of Classification Search ..... 439/76.1, 439/660, 606, 466, 468, 694, 881, 902
See application file for complete search history.

(56) References Cited

U.S. PATENT DOCUMENTS 7,232,329 B1 * 6/2007 Wu ..... 439/358
7,303,438 B2 12/2007 Dawiedczyk et al.
7,410,365 B2 8/2008 Wu
7,435,129 B2 * 10/2008 Su et al. ..... 439/606

* cited by examiner

*Primary Examiner*—Tho D Ta
(74) *Attorney, Agent, or Firm*—Wei Te Chung

(57) ABSTRACT

A plug connector, mated with a complementary connector, includes a housing, a printed circuit board received in the housing, a cable with a plurality of conductors electrically attached to corresponding electrical pads of the printed circuit board, and a fastening portion. The housing includes a front housing defining a mating interface and L-shape rear housing. The mating interface includes a pair of tongue sections and an opening defined between the tongue sections. The printed circuit board has a plurality of electrical pads formed thereon, and defines a mating portion accessible from the mating interface and parallel to the pair of tongue sections. The fastening portion includes a connecting portion received in the housing and at least one column post passing through the housing and the printed circuit board.

10 Claims, 7 Drawing Sheets

PLUG CONNECTOR WITH IMPROVED CABLE ARRANGEMENT AND HAVING RETAINING ARRANGEMENT SECURELY RETAINING MATING SUBSTRATE THEREIN

This application is related to a copending U.S. patent application Ser. invented by Xu, Bin and Liu, Su-feng assigned to the same assignee as this application.

BACKGROUND OF THE INVENTION

1. Field of the Invention

The present invention relates generally to a plug connector, and more particularly to a plug connector with circuit board connector mating substrate securely retained therein by means of a retaining pins extending therethrough.

2. Description of the Prior Art

Present electrical devices include so many internal components as to define complex internal spaces. Thus, internal connectors are needed to be adapting to the internal space.

U.S. Pat. No. 7,410,365, issued to Wu on Aug. 12, 2008, discloses a plug connector with improved engaging means that are assembled to the housing for locking board printed circuit board toward the housing reliable. However, the conventional housing extends along a horizontal direction is not adapt to some electrical devices.

Hence, in this art, a plug connector to overcome the above-mentioned disadvantages of the prior art should be provided.

BRIEF SUMMARY OF THE INVENTION

A primary object, therefore, of the present invention is to provide a plug connector with small structure.

In order to implement the above object, the plug connector, mated with a complementary connector, comprises a housing, a printed circuit board received in the housing, a cable with a plurality of conductors electrically attached to corresponding electrical pads of the printed circuit board, and a fastening portion. The housing comprises a front housing defining a mating interface and L-shape rear housing. The mating interface comprises a pair of tongue sections and an opening defined between the tongue sections. The printed circuit board has a plurality of electrical pads formed thereon, and defines a mating portion accessible from the mating interface and parallel to the pair of tongue sections. The fastening portion comprises a connecting portion received in the housing and at least one column post passing through the housing and the printed circuit board.

Other objects, advantages and novel features of the invention will become more apparent from the following detailed description of a preferred embodiment when taken in conjunction with the accompanying drawings.

DETAILED DESCRIPTION OF THE INVENTION

Figure 1:
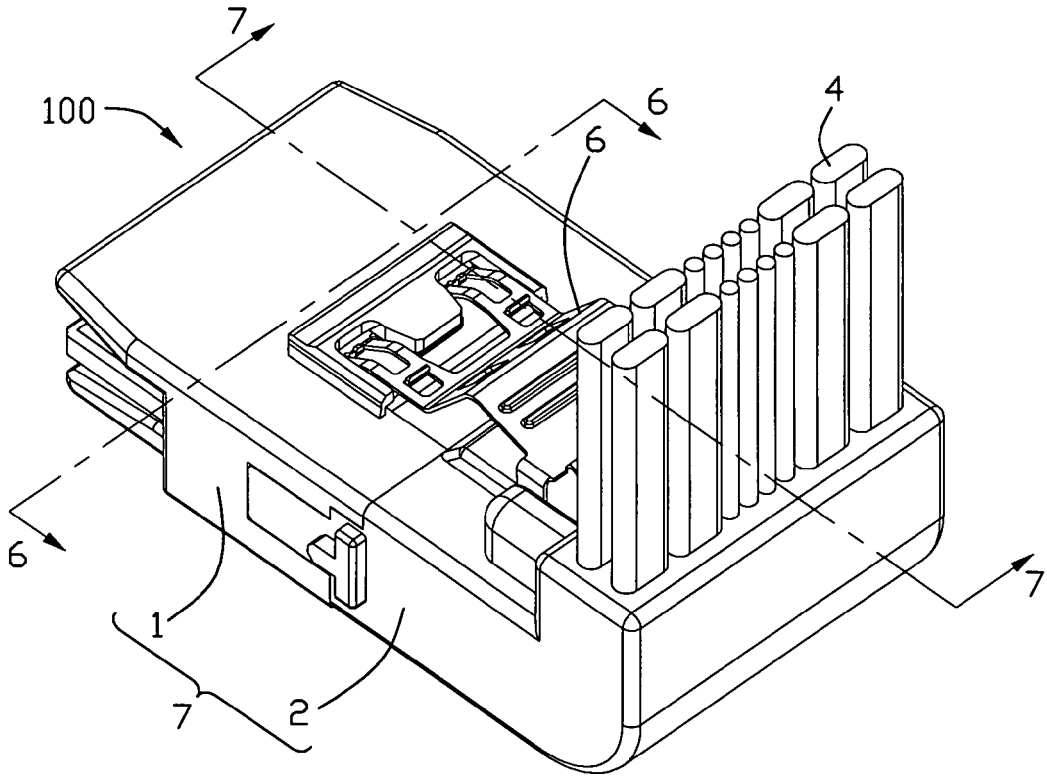
FIG. 1 is a perspective view of a plug connector in according with the present invention.

Reference will now be made in detail to a preferred embodiment of the present invention.

FIGS. 1 to 4 illustrate perspective views of an electrical plug connector 100 made in accordance with the present invention and used to exchange electrical signals and be connected to the complementary connector (not shown). The plug connector 1 comprises a housing member 7 having receiving space therein and configured by a front piece and a rear piece, a printed circuit board 3 securely assembled in the receiving space of the housing member 7, a plurality of cables 4 electrically terminated with the printed circuit board 3, a latch 6 assembled on the housing member 7 for inter locking with the complementary connector, and a fastening portion 8.

Figure 5:
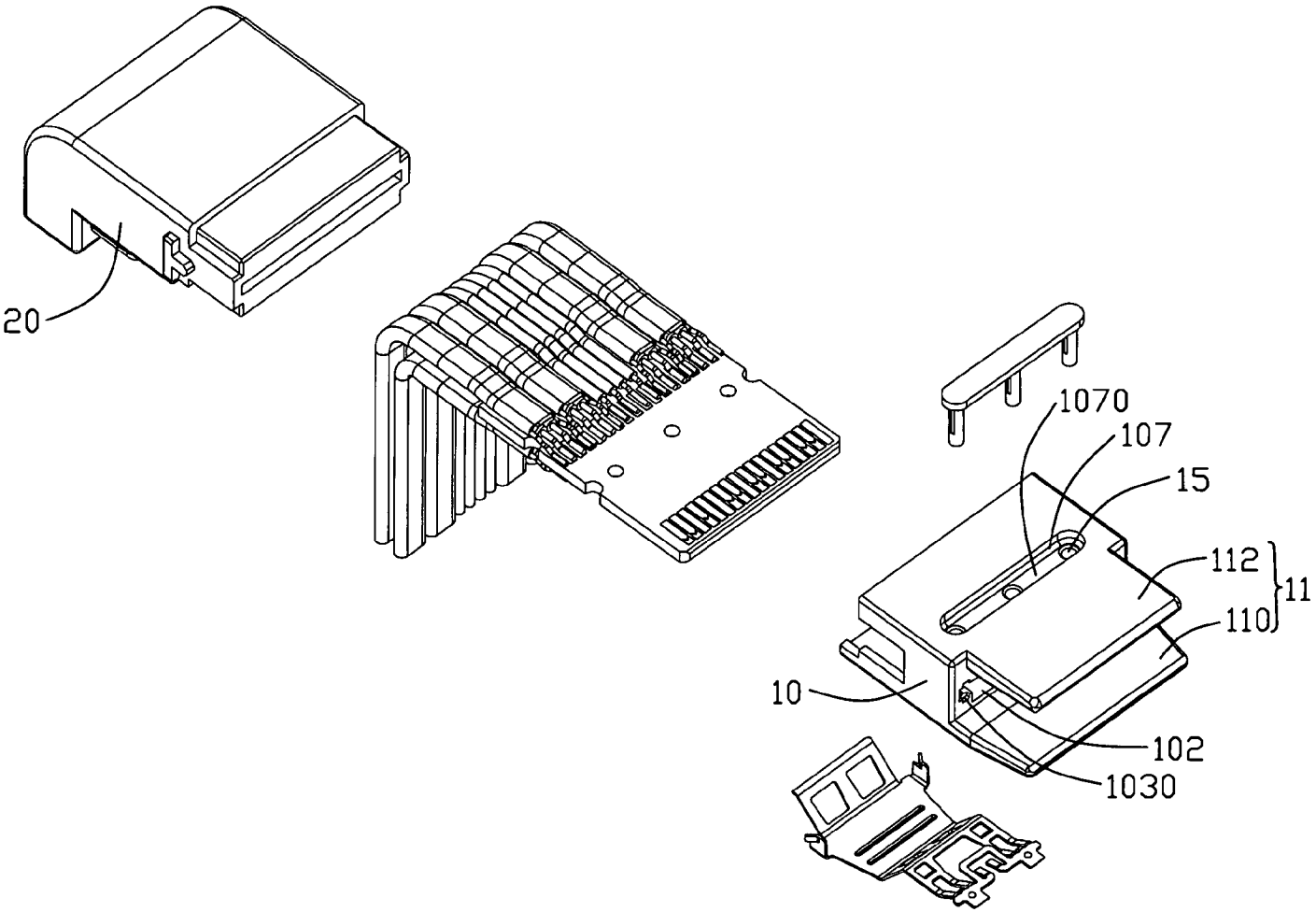
Figure 6:
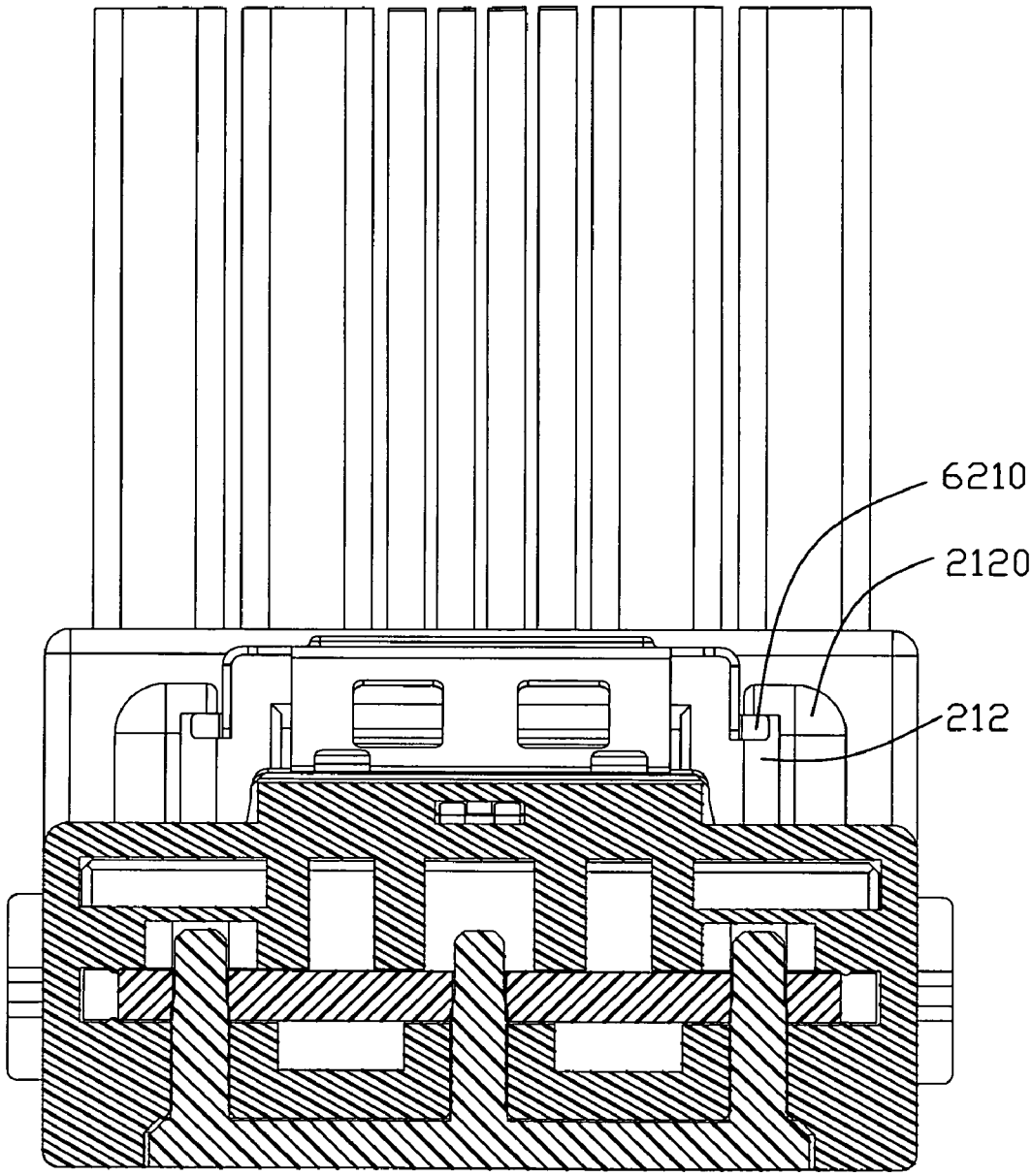
FIGS. 6-7 are cross-section views of the plug connector taken along lines 7-7 to 8-8 of FIG. 1.
Figure 7:
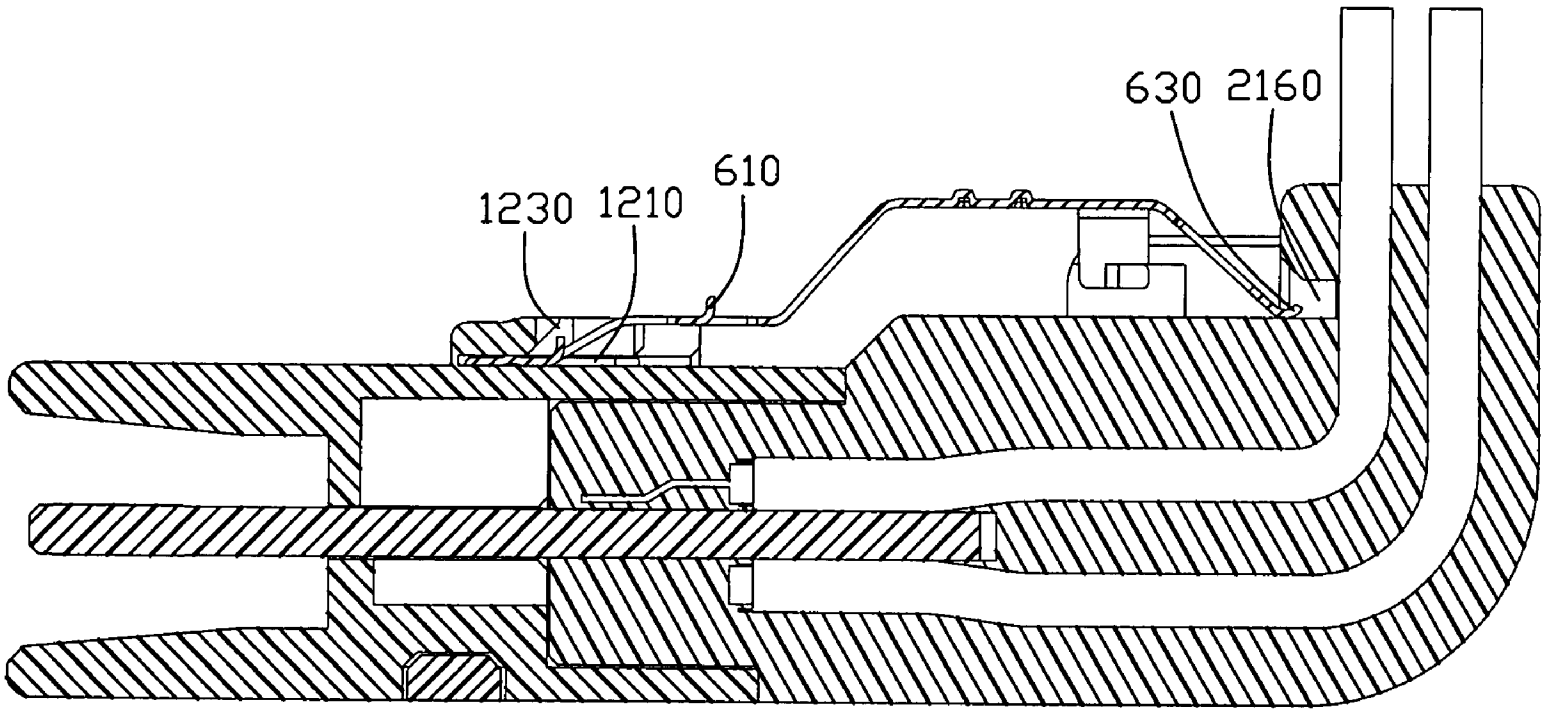

Referring to FIGS. 5 to 7, the front housing piece 1, which is made of insulative material with robust rigidity or other material, such as metal, comprises a rectangular body portion 10 defining a central receiving slot (not labeled) therethrough, and a tongue portion 11 having first and second tongue sections 110, 112. The first and second tongue sections 110, 112 respectively extends forwardly from a front surface 101 of the body portion 10 and an opening (not labeled) formed between the first and second tongue sections 110, 112. The first and second tongue sections 110, 112 together with the opening form a mating interface (not labeled) of the front housing piece 1.

The body portion 10 defines a rectangular receiving space 104 recessed forwardly from a rear surface thereof to communicate with the receiving slot 102, and thus, forming a pair of longitudinal walls 105, a pair of lateral walls 103, and an inner face 106. Each lateral wall 103 defines a cutout 1030 to communicate with the outmost lateral surface of the lateral wall 103 and the receiving space 104. The receiving slot 102 recesses forwardly from the inner face to the front surface 101 of the body portion 10 and forms a pair of upper a lower surfaces opposite to each other and perpendicular to the inner face 106. Each lateral wall 103 has a cutout 1030 to form an upper lateral arm and lower lateral arm (not labeled). The outmost surface of the cutouts 1030 communicates with the corresponding lateral walls 103. A groove 107 recesses upwardly from the bottom surface of the body portion 10 to form a receiving space (not labeled) and a blocking surface 1070. Triple circular depressions holes 15 extend upwardly from the blocking surface 1070 to communicate with the receiving slot 102.

The body portion 10 forms an M-shape engaging portion 12 on a top surface and adjacent to the rear surface thereof. The engaging portion 12 comprises a protruding section 121 and a pair of arms 122 located at opposite sides of the protruding section 121, all extending rearward from a transverse main section 123. A slit 1210 (FIG. 3) is formed between the protruding section 121 and a top surface of the body portion 12 to extend into the main section 123 of the engaging portion 12. The top surface of the engaging portion 12 is higher than the top surface of the main section 123, and an inclined surface 124 is connected to the two top surfaces of the engaging portion 12 and the main section 123. A pair of trough 1220 is respectively formed in the arms 122 and open toward each other.

The rear housing piece 2 of the present invention is made of PVC material and in the form of L-shape configuration. In other alternative embodiments, the rear housing piece 2 can or also be made from other material, same as that of the front housing piece 1 or different from that of the front housing piece 1. The rear housing piece 2 comprises a main portion 20 and a guiding portion 22. The main portion 20 comprises a horizontal and rectangular first portion 214, a vertical and rectangular second portion 216, and a bending portion 218 connecting the first portion 214 to the second portion 216. A transverse slot 2160 is formed on the front surface of the second portion 216 in communication with the upper surface of the main portion 20. A flat extruding section 211 protrudes upwardly from the upper surface of the first portion to extend across the first portion 214 along front-to-rear direction. The flat extruding section 211 extends into the slot 2160 and a receiving space is defined between the upper surface of the slot and the flat extruding section 211. A pair of ear sections 212 are located at opposite sides of the extruding section 211 and connected to the second portion 216. Each one of the ear sections 212 has a recess 2120 backwardly recessed from the front surface thereof. The two recesses 2120 face to each other. The guiding portion 22 comprises a rectangular main body 220 and a pair of guiding projections 222 on opposite sides of the main body 220. The two guiding projections 222 are respectively across the two side surfaces of the main body 220 along front-to-rear direction. The outmost surface of each guiding projection 222 is coplanar with the main portion 20. A through slot 24 extends through the guiding portion 22 and into the main portion 20 to receive the part of the printed circuit board 3 and a part of the cables. The front part of the through slot 24 is between the two guiding projections 222 and has a width equal to the body portion 220.

The printed circuit board 3 has a plurality of first conductive traces 31 disposed along its leading edge which are intended to mate with the contacts (not shown) of the complementary connector when the plug connector 100 is inserted into the complementary connector, a plurality of second conductive traces 32 at middle thereof to be respectively connected to the cables 4, and triple holes 33 located between the first and second traces 31, 32 and arranged in a line. Each side edge of the printed circuit board 3 defines a pair of semicircular positioning holes 34 arranged along the front-back direction. In order to facilitate the so called hot-plug function, each of the first conductive traces 31 which are used for signal transmission are formed with a V-shape cutout 310 to let the first conductive traces 31 which are interconnected with ground contacts of the complementary connector firstly and disengaged from the complementary connector later. Such V-shape cut-outs 310 assure the signal transmission without being interrupted. Of course, the V-shape cutouts 310 also can be omitted here or have other configuration.

The cables 4 comprises two sets of sub-assemblies in a stacked relationship. Each set comprises four serial Attached Technology Attachment (ATA) standard cables 40 for high speed signal transmission and four strand wires 42 for low speed signal transmission. Of course, the strand wires 42 may not be included into the cable set in this embodiment or other embodiments according to different requirements. Each serial ATA standard cable 40 comprises a pair of signal conductors 400 respectively transmitting positive signal and negative signal, and a pair of grounding conductors 402 arranged at opposite outer sides of the pair of signal conductors 400 for providing grounding to the signal transmission.

The latch 6 is stamped and formed from a metallic sheet and comprises a retaining portion 60, a pair of locking portions 61 extending upwardly and backwardly from the retaining portion 60, a generally horizontal pressing portion 62 and an inclined supporting portion 63 slantwise extending from the pressing portion 62. The latch 6 further forms an inclined intermediate portion 64 connecting the pressing portion 62 with the locking portions 61.

The retaining portion 60 has a pair of transverse bar sections 600 respectively connecting with front edges of the locking portions 61, an engaging section 602 connecting with opposite inner ends of the pair of bar sections 600 and extending backwardly from the bar sections 600, and a pair of positioning sections 604 respectively extending forwardly from front edges of the pair of bar sections 600. Outmost end of each bar section 600 extends beyond outmost edge of corresponding locking portion 61 and served as guiding means for the latch 6. The engaging section 602 is located between the pair of locking portion 61 and comprises a rectangular frame 6020 located in a horizontal surface and a pair of elastic snapping section 6022 extending into the space circumscribed by the frame 6020 with distal ends bending upwardly. Each locking portion 61 comprises an inclined first section 612 extending rearward and upwardly from the retaining portion 60 and a flat second section 614 extending rearward from the first section 612 to connect with the intermediate portion 64. Each inclined first section defines a cutout 6120 therein for increasing flexibility thereof. Each cutout 6120 extends form the first section 612 to the second section 614. The second section 614 is formed with a pair of latch sections 610 extending upwardly and rearward form a front portion thereof. A pair of stop sections 606 are respectively formed with the bar sections 600 and extending into the cutout 6120 and curve upwardly. The pressing portion 62 comprises a body section 620 and a pair of side beams 621 extending downwardly from opposite lateral ends of the body section 620. Each side beam 621 is formed with a spring tab 6210 extending outwardly therefrom. The body section 620 is formed with a plurality of rims 6202 for easy handling. The supporting portion 63 defines a pair of rectangular openings 630 and forms a curved edge 631 at a free end thereof. The intermediate portion 64 defines a pair of elongated cutouts 640.

In assembly of the plug connector 100, the two sets of cables 4 are respectively soldered to the second conductive pads 32 located on the upper and lower surfaces of the printed circuit board 3, and then are bend at a proper position. The rear housing piece 2 is then molded over the printed circuit board 3 and the cables 4 to form a plurality of different-size receiving passages 25. The rear portion of the printed circuit board 3 is received in the through slot 24 formed in the guiding portion 22, and the cables 4 respectively protruding through the corresponding receiving passages 25 to expose out of a rear surface of the rear housing piece 2. The pair of positioning holes 34 located at a relatively rear position are filled with material of the rear housing piece 2 to increasing the retaining force between the rear housing piece 2 and the printed circuit board 3. Of course, the rear housing piece 2 can be molded firstly, and then is pushed forwardly toward the cables 4 and the printed circuit board 3 to enclose the junctions between the cables 4 and the printed circuit board 3.

The rear housing piece 2 with the cables 4 and the printed circuit board 3 is assembled to the front housing piece 1 along the back-front direction. With the guidance of the pair of guiding projections 222 of the guiding section 22 sliding into the cutouts 1030 of the lateral walls 103, the front portion of the printed circuit board 3 protrudes through the receiving slot 102 to be exposed between the first and second tongue sections 110, 112 until a front surface of the rear housing piece 2 abuts against the front inner face 106 of the front housing piece 1. Thus, the through holes 33 of the printed circuit board 3 respectively align with the arc sections of the positioning cavities 14 and the circular depression 15. To enhance the combination of the printed circuit board 3 and the front housing piece 1, the fastening portion 8 are employed. The fastening portion 8 comprises a connecting board 84 and three column posts 82 respectively attached on the connecting board 84. Each column post 82 has a rim 80 on one side thereof. The three column posts 82 respectively extend through the circular depressions 15 and the three holes 33 into receiving space of the front housing 11 with the rims 80 respectively compressing on the inner surface of the circular depressions 15, and the connecting board 84 received in the circular depression 15. Via the fastening portion 8, the printed circuit board 3 is reliably retained to the front housing piece 1 and has no possibility of being pulled out from the front housing piece 1 when user is pulling the cables 4, further enhancing the engagement between the front and rear housing pieces 1, 2. The fastening portion 8 and the three through holes 33 serve as engaging means to position the printed circuit board 3 to the front housing piece 1. Noticeably, the printed circuit board is wholly received in the housing member 7, and integrally molded with the rear housing piece 2. Similarly, the front ends of the cables 4 are integrally molded with the rear housing piece 2 for achieving a reliable connection therebetween.

Figure 2:
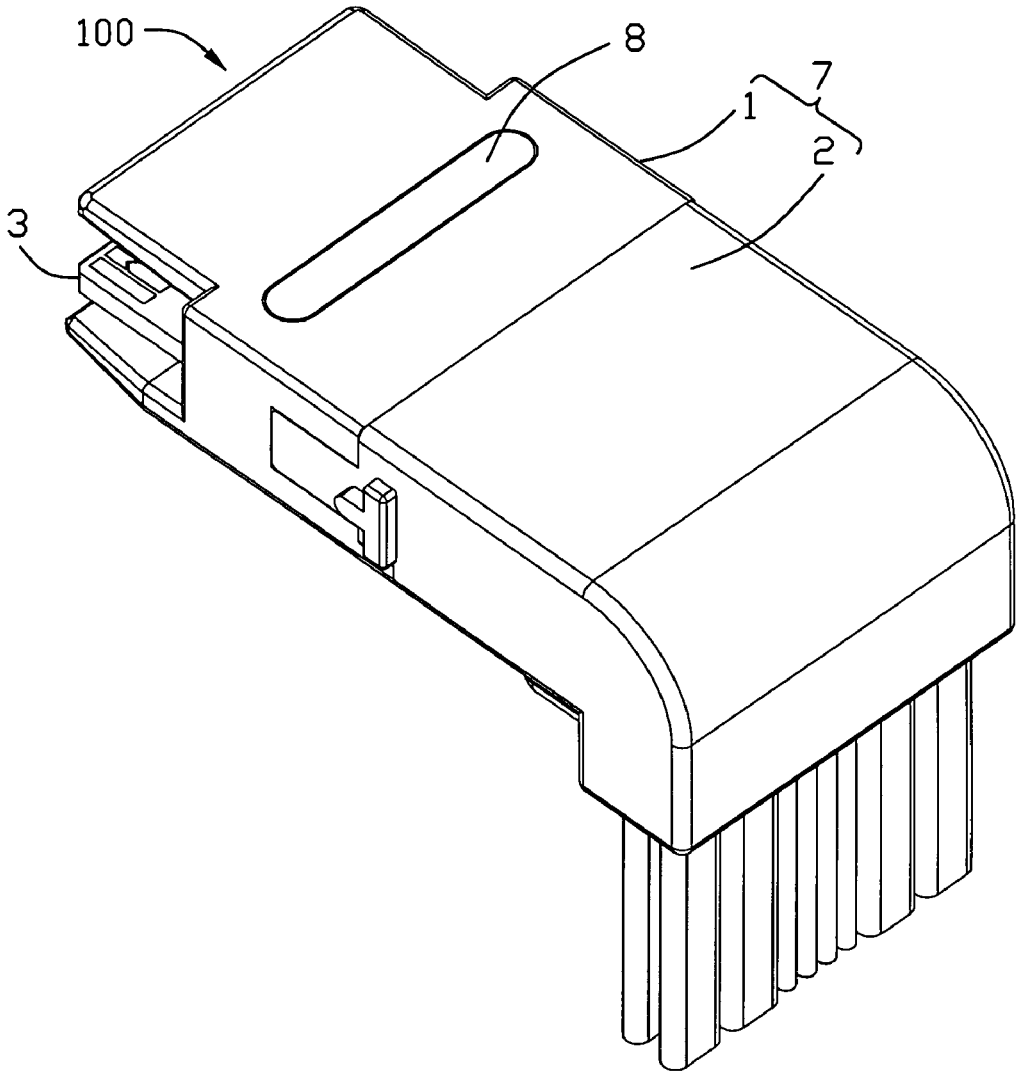
FIG. 2 is a view similar to FIG. 1, but taken from a different aspect.
Figure 3:
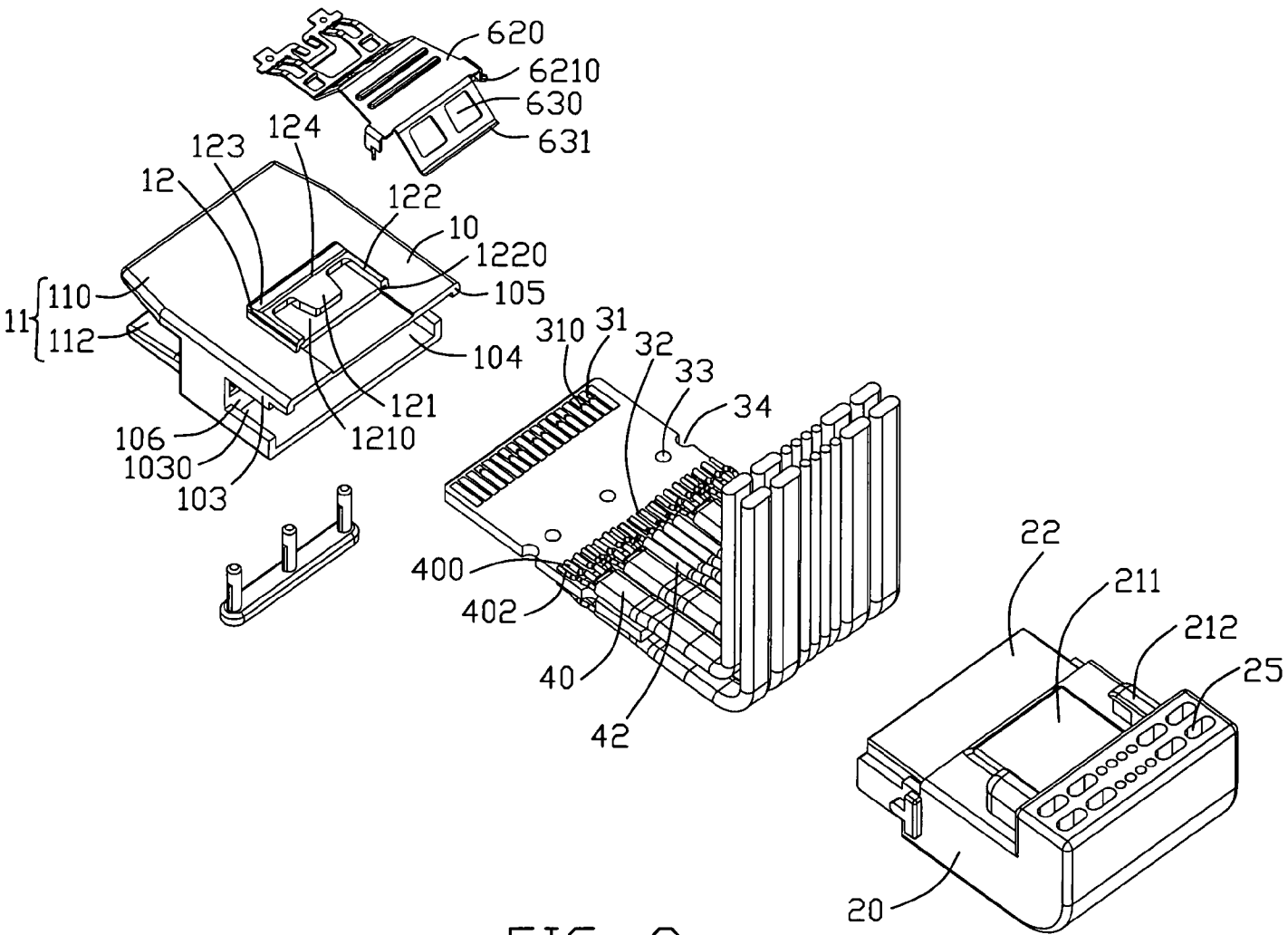
FIG. 3 is an exploded, perspective view of the plug connector in according with the present invention.
Figure 4:
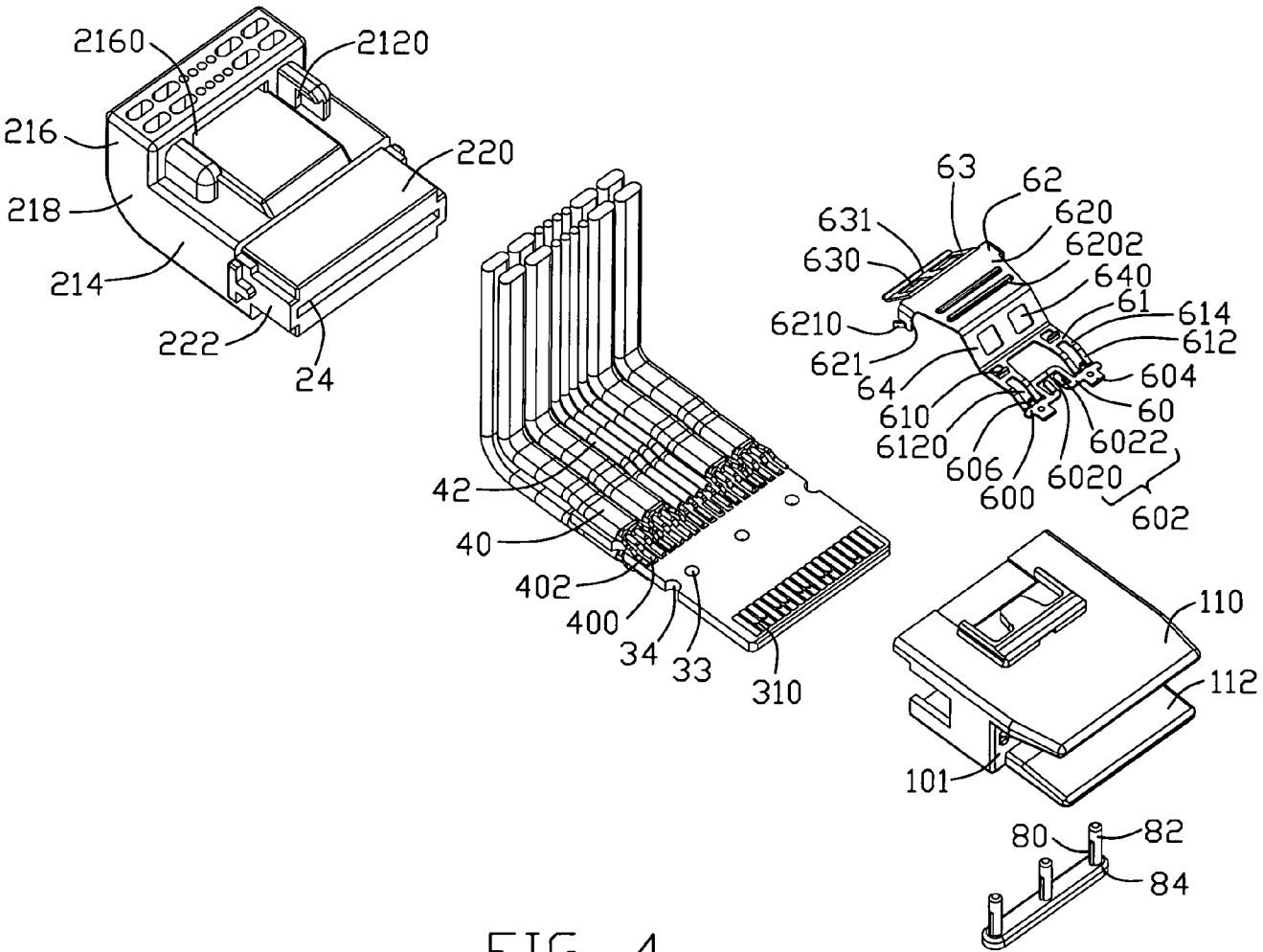
FIGS. 4-5 are views similar to FIG. 3, but taken from different aspects.

Particularly referring to FIGS. 1 to 3 in conjunction with FIGS. 4-7, the latch 6 is assembled to the front and rear housing pieces 1, 2. A forward pressing force is exerted on the latch 6. The spring tabs 6210 of the pressing portion 62 respectively slide along the recesses 2120 of the ear sections 212 of the rear housing piece 2. At the same time, with the guidance of the outmost ends of the retaining portion 60 sliding along the grooves 1220 of the arms 122 of the front housing piece 1, the bar section 600 and the engaging section 602 are received in the slit 1210 with the positioning sections 604 and the snapping sections 6022 respectively locked into the slots 1230 to prevent the latch 6 from moving rearward when the plug connector 100 mates with the complementary connector. The pair of stop sections 606 is located in front of the main section 123 for preventing excessive forward movement of the latch 6. The supporting portion 63 is located above the extruding section 211 of the rear housing piece 2 with the curved edge 631 abutting against a surface of the extruding section 211 and extending into the transverse slot 2160 of the second portion 216. The spring tabs 6210 of the pressing portion 62 elastically engage with inner surfaces of the recesses 2120 of the ear sections 212 for preventing the latch 16 from escaping the recesses 2120 of the rear housing piece 2. The pressing portion 62 is downwardly movable relative to the rear portion of the rear housing piece 2 to deflect the locking portion 61 toward the front and rear housing pieces 1, 2.

The complementary connector has corresponding structure locking with the pair of latch sections 610 of the latch 6 to realize the reliable engagement with the plug connector 100. When the plug connector 100 is to be disconnected from the complementary connector, a downward pressing force is exerted on the pressing portion 62 of the latch 16. The pressing portion 62 moves downwardly and the locking portion 61 creates a vertical displacement toward the front housing piece 1. The retaining portion 60 is engaged with the front housing piece 1 and the supporting portion 63 extends into the transverse slot 2160 to press on the rear housing piece 2, thus, together form a girder. The vertical displacement of the locking portion 61, particularly the latch sections 610, is big spatially enough to realize the disconnection between the plug connector 100 and the complementary connector easily.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector for mating with a complementary connector, comprising:

a housing comprising a front housing defining a mating interface and a L-shape rear housing, said mating interface comprising a pair of tongue sections and an opening defined between the tongue sections;

a printed circuit board received in the housing and having a plurality of electrical pads formed thereon, the printed circuit board defining a mating portion accessible from the mating interface and parallel to the pair of tongue sections;

a cable with a plurality of conductors electrically attached to corresponding electrical pads of the printed circuit board;

a fastening element securely anchored to the housing and having at least one column post extending through the printed circuit board; and a latch stamped and formed from a metallic plate, said latch comprising a retaining portion, a pair of locking portions extending upwardly and backwardly from the retaining portion, a generally horizontal pressing portion and an inclined supporting portion slantwise extending from the pressing portion;

wherein the rear housing piece comprises a horizontal and rectangular first portion, a vertical and rectangular second portion, and a bending portion connecting the first portion to the second portion;

wherein the second portion comprises a transverse slot on the front surface thereof to communicate with the upper surface of the first portion of the rear housing piece;

wherein the inclined supporting portion has a curved edge at a free end thereof, and said curved edge extending into the transverse slot of the rear housing.

2. The plug connector as claimed in claim 1, wherein the printed circuit board is wholly received in the housing and only accessible from the mating interface of the housing.

3. The plug connector as claimed in claim 1, wherein the rear housing piece is molded over the printed circuit board together with the cables.

4. The plug connector as claimed in claim 1, wherein the rear housing piece is attached to the front housing piece for together receiving the printed circuit board therein.

5. The plug connector as claimed in claim 1, wherein the fastening element comprises a connecting portion received in the housing and said column post extending through the printed circuit board and the housing.

6. The plug connector as claimed in claim 5, wherein the front housing piece comprises a groove recesses upwardly from the bottom surface thereof to form a receiving space and a blocking surface.

7. The plug connector as claimed in claim 6, wherein the front housing piece defines at least one circular depression extending upwardly from the blocking surface.

8. The plug connector as claimed in claim 7, wherein the printed circuit board comprises a plurality of first conductive traces disposed along its leading edge which are intended to mate with the contacts of the complementary connector, a plurality of second conductive traces at middle thereof, and at least one hole located between the first and second traces.

9. The plug connector as claimed in claim 8, wherein the connecting portion of the fastening portion is received in the receiving space of the front housing and the column post pass through the circular depression of the rear housing and the holes of the printed circuit board.

10. The plug connector as claimed in claim 8, wherein the column post comprises a rim compressing on the inner surface of the circular depression.

* * * * *